United States Patent [19]

Goller et al.

[11] 3,989,474

[45] Nov. 2, 1976

[54] AUSTENITIC STAINLESS STEEL

[75] Inventors: George N. Goller, Towson; Ronald E. Espy, Randallstown, both of Md.

[73] Assignee: Armco Steel Corporation, Middletown, Ohio

[22] Filed: Oct. 20, 1975

[21] Appl. No.: 623,963

Related U.S. Application Data

[60] Division of Ser. No. 445,482, Feb. 25, 1974, Pat. No. 3,940,266, which is a continuation of Ser. No. 238,862, March 28, 1972, abandoned, which is a continuation-in-part of Ser. No. 868,893, Oct. 23, 1969, abandoned.

[52] U.S. Cl. ..... 29/193; 29/196.1; 75/128 A; 75/128 N; 148/38

[51] Int. Cl.[2] ..... C22C 38/58

[58] Field of Search ..... 75/128 A, 128 N; 148/38; 29/196.1, 193

[56] References Cited

UNITED STATES PATENTS

| | | | |
|---|---|---|---|
| 2,778,731 | 1/1957 | Carney | 75/126 J |
| 3,151,979 | 10/1964 | Carney | 75/128 A |
| 3,192,041 | 6/1965 | Kanter | 75/128 A |
| 3,904,401 | 9/1975 | Mertz | 75/128 A |

FOREIGN PATENTS OR APPLICATIONS

| | | | |
|---|---|---|---|
| 778,597 | 7/1957 | United Kingdom | 75/128 A |

*Primary Examiner*—Arthur J. Steiner

*Attorney, Agent, or Firm*—Melville, Strasser, Foster & Hoffman

[57] ABSTRACT

A stress corrosion resistant austenitic stainless steel essentially consisting of from 15.5% to 20% chromium, from 11% to 14% manganese, from 1.1% to 3.75% nickel, from 0.01% to 0.12% carbon, from 0.20% to 0.38% nitrogen, and balance substantially iron. Phosphorous may be present up to 0.06% maximum, sulfur up to 0.04% maximum, and silicon up to 1% maximum. The steel has high strength at room temperature, good stability when severely cold worked, good cryogenic strength and toughness, wear resistance and excellent fusion welding characteristics, making it useful for a multiplicity of cryogenic applications, fabrication of welded articles, and cold-drawn wire.

8 Claims, 1 Drawing Figure

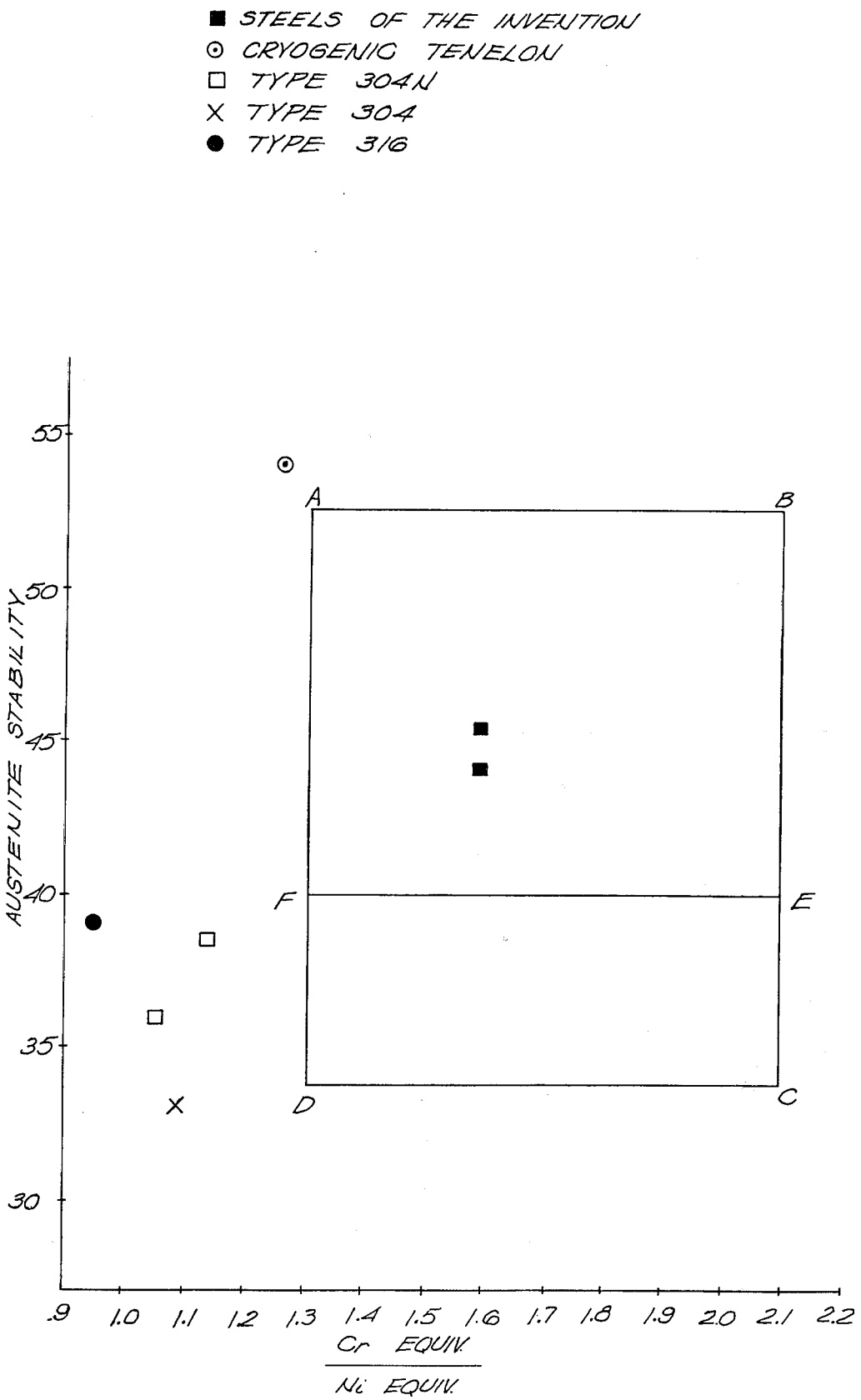
■ STEELS OF THE INVENTION
⊙ CRYOGENIC TENELON
□ TYPE 304N
X TYPE 304
● TYPE 316
AUSTENITE STABILITY
55
50
45
40
35
30
A
B
C
D
E
F
.9
1.0
1.1
1.2
1.3
1.4
1.5
1.6
1.7
1.8
1.9
2.0
2.1
2.2
Cr EQUIV.
Ni EQUIV.

AUSTENITIC STAINLESS STEEL

CROSS-REFERENCE TO RELATED APPLICATION

This is a division of application Ser. No. 445,482 filed Feb. 25, 1974, now U.S. Pat. No. 3,940,266 which is a continuation of application Ser. No. 238,862 filed Mar. 28, 1972, now abandoned, which in turn was a continuation-in-part of application Ser. No. 868,893 filed Oct. 23, 1969, now abandoned.

BACKGROUND OF THE INVENTION

1. Field of the Invention

The present invention relates to an austenitic chromium-manganese-nickel-nitrogen stainless steel having a relatively low nickel content, which exhibits a unique combination of properties enabling its use in cryogenic applications requiring low temperature toughness and good resistance to cracking in chloride corrosive media where resistance to stress corrosion is needed, and in the production of cold reduced articles which have great tensile strength and low magnetic permeability. While not so limited, the alloys of the invention have particular utility in the fabrication of welded pressure vessels for cryogenic service requiring high strength at room temperature together with good cryogenic toughness and stability.

2. Description of the Prior Art

Periodic scarcities of nickel, and its relatively high cost, have stimulated workers in the art to develop nickel-free or low nickel austenitic alloys. Over a period of years many such alloys have been investigated.

An article by R. Franks, W. Binder and J. Thompson (A.S.M. Transactions, Vol. 47, pp. 231–266, 1955) discloses the structural constitution of steels containing about 0.1% carbon and about 0.15% nitrogen at chromium levels of 12 to 18%, 0 to 22% manganese and 0 to 14% nickel. It was there concluded that a fully austenitic structure cannot be produced with manganese alone at chromium levels above about 15%, despite the fact that carbon and nitrogen expand the austenitic region in steels of this composition range and are more potent in this respect than nickel.

U.S. Pat. No. 2,778,731, issued Jan. 22, 1957 to D. J. Carney discloses an austenitic low nickel alloy steel consisting of from 17% to 18.5% chromium, 14% to 20% manganese, 0.05% to 1.00% nickel, 0.06% to 0.15% carbon, 0.25% to 1.0% nitrogen, 0.25% to 1.0% silicon, and balance iron. The steel of that patent was alleged to have high strength and a high work-hardening rate and to be comparable in mechanical properties to AISI Types 301 and 302. The steel is currently sold by U.S. Steel Corporation under the registered trademark TENELON, having the following composition range: chromium 17.0–19.0%, manganese 14.5–16%, nickel 0.75% maximum, carbon 0.08–0.12%, nitrogen 0.35% minimum, silicon 0.75% maximum and remainder iron.

Reference may also be made to U.S. Pat. No. 2,820,725 issued Jan. 21, 1958, to R. D. Wasserman et al.; U.S. Pat. No. 3,151,979 issued Oct. 6, 1964 to D. J. Carney et al.; and U.S. Pat. No. 3,192,041 issued June 29, 1965, to J. J. Kanter et al.

Among other high-strength low nickel austenitic alloys which have been developed are a Type 16-16-1 and Allegheny-Ludlum Type 205. Type 16-16-1 contains from 15% to 16% carbon, 0.20% maximum nitrogen, 0.20% to 0.70% silicon, and remainder substantially iron. Allegheny Type 205 contains from 16% to 18% chromium, 14.0% to 16.0% manganese, 1.1% to 2.0% nickel, 0.12% to 0.25% carbon, 0.32% to 0.40% nitrogen, 0.2% to 0.7% silicon, and remainder substantially iron.

It has been previously believed that if manganese is substituted for nickel as an austenite former, the substitution should be made on a 2:1 basis. An article in *Metal Progress Data Sheet*, February 1960, page 100-B, by A. Schaeffler, contains a constitution diagram in which manganese is considered to be one-half as potent as nickel as an austenite former in high-chromium alloys containing about 0.10% nitrogen.

Present standard austenitic stainless steels used for cryogenic service include AISI Types 304, 304-N, 316, Armco 21-6-9, and most recently U.S. Steel Cryogenic TENELON.

Although Type 304 has good toughness at cryogenic temperatures, it transforms to untempered martensite when deformed and hence has poor fatigue life. Its melting specifications call for from 8.00 to 10.50% nickel, and hence it is relatively expensive. Moreover, it has relatively low room temperature tensile and yield strengths (about 85 and 35 ksi, respectively, in the annealed condition), and the design stresses must thus be kept at low values.

Type 304-N is somewhat stronger than Type 304 at room temperature but is still subject to transformation to martensite at cryogenic temperatures, which tends to a lower fatigue life.

Type 316, because of its high nickel content (from 10% to 14%), is more stable against transformation to martensite at cryogenic temperatures, which is conductive to good fatigue life, but use of the alloy severely limits design stresses because of its low strength at room temperature.

Armco Type 21-6-9 is stable against transformation to martensite at cryogenic temperatures, but also has the disadvantage of being expensive because of a relatively high nickel content.

Cryogenic TENELON (which has a nominal composition of 0.08% carbon, 16% manganese, 18% chromium, 5.5% nickel, 0.38% nitrogen and remainder substantially iron) achieves good room temperature strength levels and stability against martensite transformation at low temperatures, but has the disadvantages of a relatively high nickel content, poor weldability, and poor stress corrosion resistance. It also has substantially lower impact values at cryogenic temperatures than Type 304. Data on cryogenic TENELON are given in a reprint of a paper by C. E. Spaeder, Jr., et al., in *Metals Engineering Quarterly*, *ASM*, August 1969, pages 1–15.

Stress corrosion resistance is another important property of stainless steels in many applications, such as formed and/or welded vessels used in chemical processing. The residual stresses in such vessels or other products cannot be relieved by annealing because of their size, and the stresses are often high enough to cause cracking in certain environments. All the previously mentioned prior art alloys having nickel contents of about 8% suffer from stress corrosion cracking when exposed to hot-chloride-containing media while under stress.

SUMMARY

It is a principal object of the invention to provide a stress corrosion resistant stainless steel of relatively low alloy content, which by reason of its critical composition balance exhibits a unique combination of properties, viz., capacity to be work hardened to a very high strength while retaining a low magnetic permeability, high strength at room temperature, good fatigue life, cryogenic toughness and stability against martensite transformation, good general corrosion resistance, wear resistance, and excellent welding characteristics, viz., formation of a small amount of ferrite in the as deposited weld metal of fusion weldments, freedom from weld deposit porosity and from harmful carbides in the heat affected zone. In their broad range the steels of the invention consist essentially of from 15.5% to 20% chromium, from 11% to 14% manganese, from 1.1% to 3.75% nickel, from less than 0.01% to 0.12% carbon, from 0.20% to 0.38% nitrogen, and balance substantially iron except for incidental impurities which do not affect the properties of the alloys. Phosphorus may be present up to 0.06% maximum, sulfur up to 0.04% maximum, and silicon up to 1% maximum. In a preferred range for cryogenic applications, the steels of this invention consist essentially of from about 15.5% to about 20% chromium, from about 11% to about 14% manganese, from about 2.50% to about 3.75% nickel, from about 0.01% to about 0.06% carbon, from about 0.20% to about 0.38% nitrogen, phosphorus up to 0.06% maximum, sulfur up to 0.04% maximum, silicon up to 1% maximum, and remainder substantially iron except for incidental impurities.

In a more preferred range for cryogenic applications, which results in optimum properties, the steels consist essentially of from about 17.50% to about 18.50% chromium, from about 12.25% to about 13.75% manganese, from about 2.75% to about 3.50% nickel, from about 0.03% to about 0.05% carbon, from about 0.23% to about 0.35% nitrogen, phosphorus up to about 0.04% maximum, sulfur up to about 0.03% maximum, silicon about 0.2% to about 0.7% and balance substantially iron except for incidental impurities.

In a preferred range for hot rolled bar, rod and the like (e.g. shafting for marine use) or for cold reduced strand-like articles of high strength (e.g. cold-drawn wire) the steels consist essentially of from about 15.5% to about 20% chromium, from about 11% to about 14% manganese, from about 1.1% to about 2.5% nickel, from about 0.06% to about 0.12% carbon, from about 0.20% to about 0.38% nitrogen, up to about 0.06% phosphorus, up to about 0.04% sulfur, up to about 1% silicon, and balance substantially iron except for incidental impurities.

In a more preferred range this lower nickel and higher carbon embodiment consists essentially of from about 17.0% to about 19.0% chromium, from about 11.5% to about 13.5% manganese, from about 1.1% to about 2.0% nickel, from about 0.08% to about 0.12% carbon, from about 0.27% to about 0.35% nitrogen, up to about 0.04% phosphorus, up to about 0.03% sulfur, from about 0.2% to about 0.7% silicon, and remainder substantially iron except for incidental impurities.

Any molybdenum present as an impurity should be restricted to a maximum of 0.5% since a greater amount would adversely affect stress corrosion resistance.

Copper and cobalt are undesirable in the steel of this invention since both elements adversely affect stress corrosion resistance. Copper should not exceed 0.5% maximum for this reason.

Columbium and/or vanadium may be added in amounts of 0.1% to 0.5% each for increased strength and grain size refinement. Titanium is believed to have the same effect, but the addition of titanium would reduce cryogenic toughness, as would columbium and/or vanadium in amounts greater than 0.5%.

Boron may be added in amounts up to 0.01% where increased hot workability is desired.

The elements carbon, manganese, chromium, nickel and nitrogen, and the composition balance therebetween, are in every sense critical. If one of these elements is omitted, or if the critical percentage ranges are not observed, one or more of the novel combination of properties is lost.

Carbon is preferred, in amounts of at least about 0.03%, in order to impart high tensile and yield strengths at room temperature and to act as an austenite former. For certain applications, carbon may be present in amounts less than 0.03%, i.e. down to 0.01%, since nitrogen can be relied upon to exert a similar effect on the tensile and yield strengths of the steel. A maximum carbon content of 0.06% must be observed for cryogenic applications. It has been found that cryogenic toughness decreases sharply if the carbon content exceeds the preferred maximum of 0.05% for material in the sensitized condition, e.g. the heat affected zone of a weld. For cold drawn wire, carbon up to 0.12% in combination with lower nickel contents, is desirable for increased strength and wear resistance. However, carbon in excess of 0.12% cannot be tolerated because of its adverse effects on weldability and corrosion resistance, and difficulty in fully dissolving carbides in annealing during subsequent processing.

At least 11% manganese is required in order to stabilize the austenitic structure, impart toughness and hold nitrogen in solution. More than 14% manganese would upset the composition balance, and preferably no more than 13.5% manganese is present because of the increased cost associated with high losses of this element in melting. Moreover, manganese in excess of 14% would lower the general corrosion resistance of the steel.

Chromium is necessary in amounts of at least 15.5% in order to impart corrosion resistance and, in combination with manganese, hold the nitrogen in solution. A lower chromium content would also reduce cryogenic toughness. More than 20% chromium cannot be tolerated, at the preferred carbon, manganese, nickel and nitrogen levels, because chromium is a ferrite former, and the presence of more than about 2% ferrite in a wrought material must be avoided for good cryogenic toughness. For these reasons about 18% chromium is preferred.

Nickel is essential in amounts of at least about 2.5% for cryogenic applications, both for its function as an austenite former and for its effect in increasing cryogenic toughness. However, more than 3.75% nickel, in an alloy having the strength described herein, offers no advantage in increased toughness and hence is undesirable in the composition of the present alloys. Of greater significance, it has been found that nickel contents greater than 3.75% result in stress corrosion failure in boiling magnesium chloride. An alloy with no more than 3.5% nickel is thus preferred for optimum properties, and a maximum of 3.75% must be observed. Moreover, more than 3.75% nickel, in combination with the other elements, at preferred levels, would eliminate the small amount of ferrite formed in weld deposits which is necessary to prevent hot cracking. For cold-drawn articles nickel as low as 1.1% may be employed with higher carbon levels, i.e. 0.06% – 0.12%.

At least 0.23% nitrogen is preferred in order to obtain high strength at room temperature. However, nitrogen is a strong austenite former, and a minimum of about 0.20% nitrogen is thus needed for this reason at the carbon, manganese, chromium and nickel levels here involved. More than 0.38% nitrogen cannot be tolerated because it decreases cryogenic toughness, and causes "gassy" heats and weld porosity. Nitrogen contents greater than 0.38% will also cause embrittlement in cold-drawn items exposed to elevated temperatures in the range of 350° – 1150° F. Silicon is limited to a maximum of about 1.0% and preferably to about 0.70%, because it is a potent ferrite former.

The precise balance among the proportions of essential elements results in an austenitic structure which has high stability when the steel is severely cold worked or subjected to cryogenic service, thereby producing several of the desirable physical properties mentioned above. This compositional balance also achieves excellent stress corrosion resistance. In addition, it has been found that an interrelation exists between austenite stability and ferrite forming tendency (as hereinafter defined) which should be observed to attain optimum properties, particularly low temperature toughness and good welding characteristics for cryogenic applications.

BRIEF DESCRIPTION OF THE DRAWING

Reference is made to the accompanying drawing which is a graphic representation of the relation between austenite stability and ferrite forming tendency in steels of the present invention.

DESCRIPTION OF THE PREFERRED EMBODIMENTS

It is known in the art that the formation of a small amount of ferrite in the as-solidified weld metal is desirable when welding austenitic stainless steels, in order to avoid hot cracking. The above-mentioned Schaeffler constitution diagram and a revision thereof to incorporate the effect of variations in nitrogen content represent a generally accepted relation between ferrite formers (such as chromium, silicon and molybdenum) and austenite formers (such as carbon, nickel, manganese and nitrogen) from which the amount of ferrite is weld deposits can be predicted.

The compositional balance of the steel of the present invention is such that from about 0.5% to about 5% ferrite is formed in an austenite matrix in an as-solidified weld metal. However, contrary to the prior art belief, applicants have found that manganese does not act as an austenite former having 0.5 times the potential of nickel in a manganese stainless steel when the manganese content is above about 2%. In other words, the austenite forming potential in the preferred steels of this invention containing from 11% to 14% manganese is not as high as would be predicted from the Schaeffler diagram.

On the other hand, applicants have found that manganese within the above range acts as a strong austenite stabilizer, and hence is effective in preventing transformation of the austenite to untempered martensite when plastically deformed. Austenite stability against transformation to martensite is relatively independent of austenite forming potential, and recognition of this independence together with the discovery that manganese increases austenite stability without substantially increasing austenite forming potential constitutes one of the most important aspects of the present invention.

Applicants have developed an austenite stability factor by assignment of values to major elements in the alloy system from which stability against transformation to martensite can be demonstrated (as measured by magnetic values taken from the faces of cryogenic impact speciments). More specifically, the factor is 30 × %N + %Mn + %Ni + 30 × %C + Cr + % Mo. When this value ranges between about 34 and about 53, the steel is relatively stable and possesses good cryogenic notch properties. Keeping in mind that the chromium range is fixed and that substantially no molybdenum is present for reasons set forth above, so that the ferrite forming potential or tendency is also fixed, manganese is one element which can be increased to increase austenite stability without increasing austenite forming potential, whereas nitrogen up to 0.2%, carbon and nickel are all potent austenite formers.

The revised Schaeffler constitution diagram assigns to nitrogen an austenite forming potential 30 times greater than that of nickel, regardless of nitrogen content. However, applicants have found that this is true only up to nitrogen contents of about 0.2%. Above this level nitrogen has been found to have little or no austenite forming potential in alloys having the general composition ranges of the steel of this invention. This will be verified by data set forth hereinafter. On the other hand, nitrogen above 0.2% apparently acts in a manner similar to manganese as an austenite stabilizer, and hence is incorporated in the above austenite stability factor.

The steel of the present invention thus exhibits an austenite forming tendency low enough to permit formation of from 0.5% to %5 delta ferrite in a weld deposit but at the same time has high austenite stability which prevents any substantial transformation to martensite when subjected to severe cold working and/or cryogenic service, as will be shown hereinafter.

It should be pointed out that the steel of this invention, when cast in ingots or slabs, would contain a small amount of delta ferrite as it does in a weld deposit. However, during hot working, the delta ferrite will transform to austenite which is then substantially completely stable against subsequent transformation.

An austenite stability factor between about 34 and 53 results in a steel having excellent stress corrosion resistance, low magnetic permeability after severe cold working and/or cryogenic service, high strength at room temperature, good general corrosion resistance, good wear resistance (i.e. against calling), and good resistance against relaxation of elevated temperature in articles cold reduced to spring temper. Additionally, as indicated above, the present invention includes a determination of ferrite forming tendency (hereinafter referred to for convenience as "ferrite ratio") which governs the amount of ferrite formed in an austenite matrix in the as-solidified weld metal of a weldment. More specifically, applicants have developed a ferrite ratio as follows:

$$\frac{\text{Cr equivalent}}{\text{Ni equivalent}} = 1.3 \text{ to } 2.1$$

where Cr equivalent = % Cr + 1.5 × % Si

-continued and Ni equivalent $= \% Ni + 30 \times \% C + 7.$

The constant of 7 in the nickel equivalent is derived from:

$$30 \times 0.2\%N + 0.5 \times 2\%Mn.$$

As explained above, nitrogen does not act as an austenite former above a level of 0.2%, and manganese does not act as an austenite former above a level of 2%.

In the steels of present interest, when the ferrite ratio ranges between about 1.3 and about 2.1 and the austenite stability factor ranges between about 34 and about 53, the steels exhibit good cryogenic strength and toughness, freedom from carbides of a size which would be harmful in the heat affected zone of a weldment, freedom from porosity in a weld deposit, and formation of from about 0.5% to about 5% ferrite in the as-solidified weld metal, in addition to the previously mentioned desirable properties.

The above relationship is illustrated in the graph of the drawing wherein a rectangular area designated ABCD encompasses the austenite stability factor range of 34 to 53 and the ferrite ratio range of 1.3 to 2.1. Within this area a more preferred area designated ABEF is shown, representing an austenite stability factor range of 40 to 53 and a ferrite ratio range of 1.3 to 2.1. This area ABEF defines that within which optimum properties are achieved.

In the graph of the drawing two typical steels of the invention have been plotted, one representing a preferred composition for cryogenic applications, and the other representing a preferred composition for hot rolled bar, rod and the like, and/or cold-drawn wire. For comparison purposes, a number of prior art steels have also been plotted (cryogenic Tenelon, Types 304, 304N and 316), and it will be noted that all fall outside the area ABCD. It will thus be apparent that partial overlap of the composition ranges of the steel of this invention does not result inherently in the novel combination of properties of the invention if the critical interrelation between the austenite stability factor and ferrite ratio is not observed. Conversely, an alloy having an austenite stability factor and a ferrite ratio within the area ABCD but having a composition outside the ranges of the present invention would fail to attain the novel combination of properties of the invention. There are thus, in effect, two sets of parameters which are critical to the present invention.

Preferred and more preferred composition ranges have been set forth above, both for cryogenic applications, and for hot rolled bar, rod and the like and/or cold reduced strand-like products. Within these preferred ranges, a preferred alloy for cryogenic applications comprises the following approximate composition.

0.05% carbon, 13.0% manganese, 18% chromium, 3.0% nickel, 0.25% nitrogen, incidental amounts of phosphorus, sulfur and silicon, and remainder substantially iron.

Another preferred alloy for cryogenic use having an enchanced combination of high strength at room temperature, good stability against martensite transformation and good toughness at −320° F, and excellent weldability, comprises the following approximate composition:

0.05% carbon, 13.5% manganese, 18% chromium, 3.5% nickel, 0.35% nitrogen, up to 0.50% of an element chosen from the group consisting of vanadium, columbium and mixtures thereof, incidental amounts of phosphorus, sulfur and silicon, and remainder substantially iron.

A more preferred alloy, exhibiting optimum austenite stability, good cryogenic toughness, good stress corrosion resistance, and assuring the presence of from 0.05% to 5% ferrite in the as deposited weld metal of a fusion weldment, has the following composition:

0.04% carbon, 13.0% manganese, 18.0% chromium, 3.25% nickel, 0.28% nitrogen, 0.04% maximum phosphorus, 0.03% maximum sulfur, 0.45% maximum silicon, and remainder substantially iron.

When the alloy will be used in products which cannot be relieved of stresses due to their large sizes or intricate configuration, the preferred composition comprises less than 3.6% nickel, viz., about 2.75% to about 3.50% nickel.

A preferred composition for use in cold-drawn spring wire having an ultimate tensile strength greater than 220 ksi comprises about 0.10% carbon, about 12% manganese, about 18.5% chromium, about 1.5% nickel, about 0.35% nitrogen, incidental amounts of phosphorus, sulfur and silicon, and remainder substantially iron.

For cryogenic service design stresses are based on room temperature tensile and yield strengths, percentage of elongation and reduction of area at room temperature, impact strength at −320° F, and degree of conversion to martensite measured as magnetic transformation. Alloys of the present invention were subjected to such tests in comparison with prior art cryogenic alloys and with alloys having chromium contents above and below, nitrogen contents below and manganese contents above and below the ranges of the steel of the invention but with other components within the ranges of the steel of the invention. The compositions of the various alloys tested are set forth in Table I below, and the above mentioned properties of the alloys of Table I are set forth in Table II A below. Table II B below contains the chromium equivalent, nickel equivalent, ferrite ratio, austenite stability factor, and percent ferrite calculated (from the Schaeffler diagram) and actually measured, for representative alloys of Table I.

In addition to the tests of the mechanical and metallurgical properties of the alloys, Samples 1 through 6, 8 through 10, and 12 through 22 were subjected to stress corrosion tests in boiling magnesium chloride ($MgCl_2$). The samples were prepared by applying fusion welds to opposite sides of one-inch rounds, thereby creating tensile stresses in the outer fibers of the specimen. Whereas, samples 1–5, 8–10 and 12–17 showed no evidence of cracking in 264 hours, sample 6 exhibited surface stress cracks in this period of time. Samples 19–22 all failed after 24 hours exposure, while sample 18 failed after 120 hours exposure. The most significant difference in the compositions of these groups is the nickel content. It is evident that when nickel exceeds about 3.70%, the stress corrosion resistance suffers.

All heats were melted in an induction furnace, hot-worked and annealed at 1950° F for one-half hour, followed by a water quench.

The data of Table II A indicate that the room temperature strength of the alloys of the present invention is markedly superior to that of AISI Types 304 and 316 and substantially higher than that of Type 304-N. The toughness of the steels of this invention at −320° F is not as great as that of Types 304, 316 and 304-N. However, in this connection, it should be recognized that the toughness of the steels of this invention (ranging from 17 to 78 ft.-lb.) is excellent for cryogenic service since a minimum of 15 ft.-lb. Charpy V-notch impact strength at −320° F is considered acceptable.

It will be further noted that the alloys of this invention exhibited only slight magnetic transformation when deformed at −320° F. In contrast, Types 304 and 304-N exhibited strong magnetism due to transformation to martensite, while Type 316 exhibited slight transformation.

U.S. Steel cryogenic TENELON, (Sample 20), having a substantially higher content of alloying ingredients, particularly nickel and manganese, still exhibits room temperature properties and toughness at −320° F. comparable to those of the present invention, but as pointed out above, this alloy showed poor stress corrosion resistance.

Samples 12 and 13 containing manganese in amounts less than required in the alloy of this invention exhibited unacceptably low toughness at −320° F and during deformation transformed to martensite at room temperature. The necessity for a manganese content of at least 11.0% in imparting austenite stability is thus demonstrated by these results.

High chromium (Samples 14 and 15) resulted in a two-phase structure containing large percentage of ferrite and unacceptably low impact strengths at −320° F.

A heat (Sample 16) containing a chromium content below the required minimum of 15.5% exhibited an unacceptably low impact strength at −320° F.

Table II B tabulates calculations of the critical ferrite ratio and austenite stability factor of representative steels of the invention and prior art steels. It will be noted that the steels of the invention fall within the area ABCD of the graph while the prior art steels are outside this area. Moreover, while a low manganese alloy (Sample 12) falls within the area ABCD, it will be noted that the actual ferrite content was 10%, thus demonstrating the criticality of both composition and austenite stability vs. ferrite ratio. Similarly, a low nitrogen alloy (Sample 17) while falling within the area ABCD, has inadequate room temperature tensile and yield strengths; more specifically a yield strength in excess of 50 ksi in the hot worked and annealed condition is considered necessary.

TABLE I

| | | COMPOSITION OF STEELS* | | | | | | | |
|---|---|---|---|---|---|---|---|---|---|
| Sample | Type of Alloy | C | Mn | Cr | Ni | N | Si | Heat | |
| 1 | present invention | .046 | 11.88 | 17.76 | 1.97 | .30 | .39 | R7602 | |
| 2 | present invention | .10 | 12.07 | 17.86 | 1.75 | .38 | .50 | 7603 | |
| 3 | present invention | .053 | 12.00 | 17.00 | 3.40 | .23 | .52 | R8464 | |
| 4 | present invention | .054 | 12.16 | 17.84 | 2.74 | .33 | .44 | R7891 | |
| 5 | present invention | .056 | 12.54 | 17.46 | 2.94 | .33 | .42 | R7892 | |
| 6 | present invention | .056 | 12.79 | 17.46 | 3.71 | .33 | .42 | R7893 | |
| 7 | present invention | .12 | 11.91 | 18.65 | 1.58 | .38 | .60 | 39010 | |
| 8 | high Mn | .041 | 14.8 | 18.05 | 2.05 | .31 | .33 | R7821 | |
| 9 | high Mn | .015 | 15.12 | 17.37 | 1.87 | .32 | .21 | R7368 | |
| 10 | high Mn | .110 | 15.04 | 17.99 | 2.11 | .30 | .32 | R7822 | |
| 11 | high Mn | .043 | 14.52 | 17.41 | 1.38 | .33 | .33 | R7740 | .21V .14Cb |
| 12 | low Mn | .045 | 7.96 | 17.18 | 1.98 | .29 | .39 | R7601 | |
| 13 | low Mn | .052 | 5.64 | 18.07 | 1.94 | .29 | .29 | R7604 | |
| 14 | high Cr | .06 | 14.54 | 25.31 | 2.29 | .32 | .42 | R7768 | |
| 15 | high Cr | .12 | 14.52 | 25.30 | 2.23 | .32 | .40 | R7769 | |
| 16 | low Cr | .10 | 11.80 | 12.86 | 1.71 | .30 | .52 | R7804 | |
| 17 | low N | .053 | 11.70 | 15.81 | 3.33 | .15 | .52 | R8462 | |
| 18 | 304-N (AISI) | .052 | 1.74 | 18.29 | 9.6 | .16 | .54 | R7800 | |
| 19 | 304-N | .060 | 1.48 | 18.70 | 8.36 | .25 | .46 | R7802 | |
| 20 | U.S.S. Cryogenic Tenelon | .066 | 16.08 | 18.11 | 5.81 | .39 | .32 | R7823 | |
| 21 | 304 | .054 | .77 | 18.19 | 8.81 | .031 | .37 | 17105 | |
| 22 | 316 | .064 | 1.80 | 17.58 | 13.38 | .026 | .68 | 382497 | 2.55Mo |
| 23 | 21-6-9 | .045 | 8.95 | 20.46 | 6.67 | .29 | .30 | 55711 | |

*In Samples 1 through 16 phosphorus ranged from .003% to .027%, and sulfur from .010% to .029%.

TABLE II A

| | PROPERTIES OF STEELS OF TABLE I | | | | | |
|---|---|---|---|---|---|---|
| Sample | U.T.S. ksi Rm. T. | Y.S. (0.2% offset) ksi Rm. T. | % Elong. in. 2" Rm. T. | % Red in Area Rm. T. | Impact* ft.-lb. Charpy V-notch −320° F. | Magnetic Transformation −320° F. during Deformation |
| 1 | 109 | 64 | 54 | 70 | 21 | slight |
| 2 | 120 | 74 | 52 | 70 | 17 | very slight |
| 3 | 102 | 55 | 57 | 72 | 78 | slight |
| 4 | 109 | 66 | 49 | 71 | 36 | slight |
| 5 | 109 | 63 | 51 | 70 | 43 | slight |
| 6 | 109 | 62 | 49 | 70 | 53 | slight |

TABLE II A-continued

| Sample | U.T.S. ksi Rm. T. | Y.S. (0.2% offset) ksi Rm. T. | % Elong. in. 2" Rm. T. | % Red in Area Rm. T. | Impact* ft.-lb. Charpy V-notch −320° F. | Magnetic Transformation −320° F. during Deformation |
|---|---|---|---|---|---|---|
| | PROPERTIES OF STEELS OF TABLE I | | | | | |
| 7 | 116 | 65 | 53 | 73 | — | — |
| 8 | 108 | 59 | 54 | 70 | 31 | very slight |
| 9 | 104 | 54 | 50 | 70 | 34 | slight |
| 10 | 111 | 61 | 54 | 70 | 39 | very slight |
| 11 | 120 | 78 | 42 | 62 | 20 | very slight |
| 12 | 115 | 66 | 53 | 67 | 6 | transforms at Rm. T. |
| 13 | 126 | 65 | 52 | 51 | 5 | transforms at Rm. T. |
| 14 | 111 | 74 | 39 | 68 | 4 | 35% ferrite |
| 15 | 114 | 78 | 40 | 63 | 6 | 20% ferrite |
| 16 | 119 | 66 | 51 | 68 | 9 | slight |
| 17 | 96 | 47 | 59 | 70 | 108 | very slight |
| 18 | 93 | 44 | 53 | 70 | 78 | transforms |
| 19 | 105 | 54 | 51 | 70 | 64 | transforms |
| 20 | 113 | 61 | 49 | 69 | 40 | none |
| 21 | 86 | 46 | 59 | 69 | 110 | transforms |
| 22 | 89 | 45 | 51 | 69 | 100 | slight |
| 23 | 103 | 58 | 50 | 70 | 75 | very slight |

*Rm. Temp. impact values exceeded 100 ft-lbs. for all materials.

TABLE II B

| Sample | Type of Alloy | Cr Equiv. | Ni Equiv. | Ferrite Ratio | Austenite Stability Factor* | % Ferrite Calculated | Actual |
|---|---|---|---|---|---|---|---|
| | FERRITE RATIO vs. AUSTENITE STABILITY FACTOR | | | | | | |
| 2 | present invention | 18.65 | 11.75 | 1.59 | 45.5 | | +.5 |
| 3 | present invention | 17.77 | 11.99 | 1.48 | 40.9 | −1 | +1 |
| 4 | present invention | 18.50 | 11.36 | 1.63 | 44.3 | −6 | +2 |
| 5 | present invention | 18.09 | 11.62 | 1.55 | 44.5 | −8 | +1 |
| 6 | present invention | 18.09 | 12.39 | 1.46 | 46.0 | −9 | +.5 |
| 8 | high Mn | 18.55 | 10.28 | 1.81 | 43.5 | −1 | +4 |
| 12 | low Mn | 17.78 | 10.33 | 1.71 | 38.0 | −1 | +10 |
| 14 | high Cr | 25.94 | 10.09 | 2.57 | 54.0 | +18 | +65 |
| 16 | low Cr | 13.63 | 11.71 | 1.16 | 38.5 | −20 | 0 |
| 17 | low N | 16.57 | 11.92 | 1.38 | 36.9 | +3 | +.5 |
| 18 | 304-N | 19.08 | 18.16 | 1.05 | 36.0 | −10 | 0 |
| 19 | 304-N | 19.39 | 17.16 | 1.13 | 38.5 | −10 | 0 |
| 20 | Cryogenic Tenelon | 18.58 | 14.79 | 1.26 | 54.0 | −17 | 0 |
| 21 | 304 | 18.74 | 17.42 | 1.07 | 33.0 | +7 | +5 |
| 22 | 316 | 18.61 | 21.30 | 0.94 | 39.0 | −3 | +0.5 |

*30 × % C + % Mn + % Cr + % Ni + 30 × % N

The effect of carbon on the cryogenic impact strength of sensitized steels of the present type is illustrated in Table III below wherein the specimens were heated at 1200° F for ½ hour and air cooled to simulate the effects obtained in the heat affected zone of a weldment. It will be noted that the Samples of Table III have substantially constant manganese, nickel and nitrogen contents while the carbon content is varied. It is evident that when the carbon content exceeds about 0.06%, the cryogenic impact strength of the sensitized material drops sharply even though that of the annealed material remains about the same.

TABLE III

| Sample | C | Mn | Ni | N | Impact Strength at −320° F in ft-lbs Annealed | Annealed & Sensitized |
|---|---|---|---|---|---|---|
| 9 | .015 | 15.12 | 1.87 | .32 | 34 | 34 |
| 8 | .041 | 14.80 | 2.05 | .31 | 31 | 31 |
| 10 | .110 | 15.04 | 2.11 | .30 | 39 | 6 |

The increase in cryogenic impact strength obtained by the presence of from 11% to 14% manganese is shown in Table IV below. Here the specimens have substantially constant carbon and nickel contents while the manganese content is varied. It will be apparent that a minimum of about 11% manganese is necessary to obtain acceptable cryogenic toughness.

TABLE IV

| Sample | C | Mn | Ni | Impact Strength at −320° F in ft-lbs Annealed |
|---|---|---|---|---|
| 13 | .052 | 5.64 | 1.94 | 5 |
| 12 | .045 | 7.96 | 1.98 | 6 |
| 1 | .046 | 11.88 | 1.97 | 21 |
| 8 | .04 | 14.80 | 2.05 | 31 |

Similar effects on cryogenic impact strength in the annealed and sensitized conditions were observed for nickel, as illustrated in Table V wherein the carbon and manganese contents are substantially constant while the nickel content ranges from 1.97% to 3.71%.

TABLE V

| Sample | C | Mn | Ni | Impact Strength at −320° F in ft-lbs Annealed | Annealed & Sensitized |
|---|---|---|---|---|---|
| 1 | .046 | 11.88 | 1.97 | 21 | 21 |
| 5 | .056 | 12.54 | 2.94 | 43 | 33 |
| 6 | .056 | 12.79 | 3.71 | 53 | 46 |

The ability of austenite to remain stable when plastically deformed has been reported to enhance impact strength, and notch fatigue strength under cyclic loading. The amount of transformation to martensite undergone as a result of deformation at −320° F was thus ascertained. It was found possible to rate the relative magnetic density (as non-magnetic, very slightly magnetic, slightly magnetic, magnetic and strongly magnetic) by application of a magnetized needle to the faces of broken cryogenic impact test specimens. Table VI below summarizes data for representative heats. The amount of deformation on the face of the impact specimen has been taken into account, i.e. specimens where relatively large amounts of deformation (and hence greater cold working) had occurred could exhibit greater degrees of magnetism.

TABLE VI

| Sample | Austenite Stability Factor* | %Mn | Magnetic Transformation during Deformation at −320° F |
|---|---|---|---|
| 1 | 42.0 | 11.88 | slight |
| 3 | 40.9 | 12.00 | slight |
| 4 | 44.3 | 12.16 | slight |
| 5 | 44.5 | 12.54 | slight |
| 6 | 46.0 | 12.79 | slight |
| 12 | 38.0 | 7.96 | magnetic |
| 14 | 54.0 | 14.54 | strong |
| 18 | 36.0 | 1.74 | magnetic |
| 20 | 54.0 | 16.08 | non-magnetic |

*30 × %C + %Mn + %Cr + %Ni + 30 × %N.

As indicated in Table II, Sample 12 transformed to martensite at room temperature when deformed, while Sample 14 contained 35% ferrite at room temperature.

As stated above, applicants have found that nitrogen at levels greater than about 0.2% does not have the austenite forming potential attributed to it by the revised Schaeffler constitution diagram for alloys of the present type. Table VII below compares a series of heats wherein the nitrogen ranges downwardly from 0.33% to 0.15% and tabulates for each the amount of ferrite in as-solidified weld metal as calculated from the Schaeffler diagram, the actual amount measured and the differential between calculated and measured values.

TABLE VII

| Sample | %N | % Ferrite calculated | % Ferrite measured | Differential |
|---|---|---|---|---|
| 5 | .33 | −8 | 1 | increase 9 |
| 11 | .33 | −4 | 3 | increase 7 |
| 4 | .33 | −6 | 2 | increase 8 |
| 6 | .33 | −9 | 0.5 | increase 9.5 |
| 1 | .30 | −1 | 6 | increase 7 |
| 13 | .29 | 1 | 10 | increase 9 |
| 12 | .29 | −1 | 10 | increase 11 |
| 3 | .23 | −1 | 1 | increase 2 |
| 17 | .15 | +3 | 0.5 | decrease 2.5 |

In interpreting the data of Table VII it should be noted that the Schaeffler diagram is based on an average weld deposit size when deposited using a covered electrode. The actual measurements reported above were based on a gas-tungsten arc weld which is characteristically smaller (thus solidifying more rapidly) and hence lower ferrite contents were exhibited. However, the lower ferrite contents for the actual measurements were constant throughout, and the significant finding was that the differential between 0.23% and 0.15% nitrogen was from an increase of 2 to a decrease of 2.5. This indicates that nitrogen in excess of about 0.2% has no further effect in forming austenite.

Prior art stainless steels used for the production of cold-drawn wire of high tensile strength include AISI Types 301 and 302, and U.S. Steel TENELON. The steel of the present invention has been found to possess high strength and can be drawn to an ultimate tensile strength of at least about 200 ksi and a yield strength (0.2% offset) of at least about 165 ksi in a final pass of about 40% reduction. The work-hardening capacity of the alloy of this invention is substantially higher than that of the three prior art alloys above mentioned, and the other physical properties of the steel of this invention are at least favorable in comparison thereto. The higher work-hardening ability of the present steel makes it possible to draw a rod to final thickness in a single pass of about 40% cold reduction, whereas Type 302 requires a total cold reduction on the order of 60% in order to reach an ultimate tensile strength of 200 ksi, thereby necessitating two passes when using Type 302.

The heat of Sample 7 analyzing 18.65% chromium, 11.91% manganese, 1.58% nickel, 0.12% carbon, 0.38% nitrogen, 0.015% phosphorus, 0.010% sulfur, 0.60% silicon, and balance substantially iron, was subjected to tests in order to ascertain cold drawn mechanical properties. The data are set forth below in Table VIII and are based on unstraightened wire having a starting size of ¼ inch round which has been annealed at 1950° F for ½ hour and water quenched. It had an annealed hardness of $R_B$ 98.

TABLE VIII

| Percent Cold Reduction | U.T.S. ksi | Y.S. (0.2% offset) ksi | % Elong. 2" | % Reduction in Area |
|---|---|---|---|---|
| 10 | 148 | 110 | 40 | 63 |
| 20 | 170 | 138 | 25 | 58 |
| 30 | 190 | 158 | 17 | 53 |
| 40 | 215 | 180 | 12 | 48 |
| 50 | 238 | 203 | 10 | 43 |
| 60 | 265 | 238 | 10 | 40 |

The ¼ inch round starting material was prepared from a 4 inch square billet. The 4 inch square billet exhibited an ultimate tensile strength of 116 ksi, a yield strength (0.2% offset) of 65 ksi, a percent elongation in 2 inches of 53 and a percent reduction in area of 73.

A coil of this steel was roughed to .099 inch round, annealed at 1900° F, pickled and finished in a single pass to 0.075 inch round, a reduction of area of 43%, at a speed of 100 feet per minute. The resulting ultimate tensile strength was 220 ksi. By way of comparison, in attempting to draw wire of the same thickness with AISI Type 302, a total reduction of 58% was required in order to attain an ultimate tensile strength of 220 ksi. This required two passes, the first at a speed of 100 feet per minute, and the second at a speed of 60 feet per minute in order to prevent scratching of the wire.

The steel of the invention may be prepared by melting in the electric furnace. It may be further refined, and poured into ingots or continuously cast into slabs. It is then usually hot worked and cold worked into plate, sheet strip, bar, rod or wire, e.g. spring wire or weld wire. In some instances, the steel may be used in the cast or forged condition, as well as fabricated into shaped articles which may involve welding.

Strip, sheet, bar, castings, forgings and the like, and fabricated articles for cryogenic use, which may involve welding, hot working and/or cold working, having the preferred and more preferred composition ranges set forth above for cryogenic appliations and falling within the area ABCD of the accompanying graph, exhibit excellent stress corrosion resistance, high austenite stability, low magnetic permeability, high cryogenic strength and toughness, and high yield strength at room temperature. Additionally, when such articles are welded they are free of weld deposit porosity, free of harmful carbides in the heat affected zone of the weld, and contain from about 0.5% to 5% ferrite in an austenite matrix in the assolidified weld metal. The steel is thus particularly suitable for fusion welding.

Hot rolled bar, rod and the like, and/or wire cold-drawn to spring temper, having the preferred and more preferred composition ranges set forth above for such applications and falling within the area ABCD of the accompanying graph, possess excellent stress corrosion resistance, a substantially austenitic structure, low magnetic permeability, high tensile and yield strengths at room temperature, and good wear resistance. Additionally, when cold-drawn to spring temper, such strand-like articles exhibit resistance to relaxation at elevated temperature and will have a magnetic permeability of less than 1.02 $\mu$ at 50 oersteds after 75% cold reduction.

While the invention has been described in its preferred embodiments, it is to be understood that modifications may be made therein without departing from the spirit and scope of the invention, and no limitations are to be inferred except as set forth in the following claims.

The embodiments of the invention in which an exclusive property or privilege is claimed are defined as follows:

1. A fusion welded article free of weld deposit porosity, containing from about 0.5% to about 5% ferrite in an austenite matrix in the as-solidified weld metal, being free from harmful carbides in the heat affected zone of the weldment, exhibiting no stress corrosion failure after 264 hours exposure to boiling magnesium chloride solution, by the hereinbefore described test, and having a Charpy V-notch impact strength of 15 ft-lb minimum at −320° F, said article and weldment consisting essentially of from 15.5% to 20% chromium, from 11% to 14% manganese, from 2.50% to 3.75% nickel, from 0.01% to 0.06% carbon, from 0.20% to 0.38% nitrogen, up to 0.06% phosphorus, up to 0.04% sulfur, up to 1% silicon, and remainder substantially iron except for incidental impurities.

2. A cold-worked article exhibiting no stress corrosion failure after 264 hours exposure to boiling magnesium chloride solution by the hereinbefore described test, having a Charpy V-notch impact strength of 15 ft-lb minimum at −320° F in the wrought and annealed condition, and high yield strength at room temperature, said article consisting essentially of from about 17.50% to about 18.50% chromium, from about 12.25% to about 13.75% manganese, from about 2.75% to about 3.50% nickel, from about 0.03% to about 0.05% carbon, from about 0.23% to about 0.35% nitrogen, up to about 0.04% phosphorus, up to about 0.03% sulfur, from about 0.2% to about 0.7% silicon, and remainder substantially iron except for incidental impurities.

3. Stainless steel strip, sheet, bar, and forgings, exhibiting no stress corrosion failure after 264 hours exposure to boiling magnesium chloride solution by the hereinbefore described test, having a Charpy V-notch impact strength of 15 ft-lb minimum at −320° F in the annealed condition, and excellent fusion welding characteristics such as weld deposits containing up to about 5% ferrite, freedom from porosity and from harmful carbides in the heat affected zone of a weldment, consisting essentially of from about 17.50% to about 18.50% chromium, from about 12.25% to about 13.75% manganese, from about 2.75% to about 3.50% nickel, from about 0.03% to about 0.05% carbon, from about 0.23% to about 0.35% nitrogen, up to about 0.04% phosphorus, up to about 0.03% sulfur, from about 0.2% to about 0.7% silicon, and remainder substantially iron except for incidental impurities.

4. Hot rolled stainless steel bar, and rod exhibiting no stress corrosion failure after 264 hours exposure to boiling magnesium chloride solution by the hereinbefore described test, having a Charpy V-notch impact strength of 15 ft-lb minimum at −320° F in the annealed condition, high strength at room temperature, and good wear resistance, consisting essentially of from 15.5% to 20% chromium, from 11% to 14% manganese, from 1.1% to 2.5% nickel, from 0.06% to 0.12% carbon, from 0.20% to 0.38% nitrogen, up to 0.06% phosphorus, up to 0.04% sulfur, up to 1% silicon, and balance substantially iron except for incidental impurities.

5. Stainless steel wire cold-drawn to spring temper having a substantiallly austenitic structure, exhibiting no stress corrosion failure after 264 hours exposure to boiling magnesium chloride solution by the hereinbefore described test, high tensile and yield strengths at room temperature, a magnetic permeability of less than 1.02 $\mu$ at 50 oersteds, having a Charpy V-notch impact strength of 15 ft-lb minimum at −320° F in the annealed condition, and resistance to relaxation at elevated temperature, consisting essentially of from 15.5% to 20% chromium, from 11% to 14% manganese, from 1.1% to 2.5% nickel, from 0.06% to 0.12% carbon, from 0.20% to 0.38% nitrogen, up to 0.06% phosphorus, up to 0.04% sulfur, up to 1% silicon, and balance substantially iron except for incidental impurities.

6. Stainless steel wire according to claim 5 subjected to a single final pass of about 40% cold reduction, having a room temperature ultimate tensile strength of about 200 ksi and a yield strength of about 180 ksi, containing about 18.6% chromium, about 11.9% magnanese, about 1.6% nickel, about 0.12% carbon, about 0.38% nitrogen, about 0.015% phosphorus, about 0.010% sulfur, about 0.60% silicon, and balance substantially iron.

7. A cold-drawn strand-like article having high strength at room temperature, good galling resistance, good weldability, exhibiting no stress corrosion failure after 264 hours exposure to boiling magnesium chloride by the hereinbefore described test, and having a Charpy V-notch impact strength of 15 ft-lb minimum at −320° F in the annealed condition, said article consisting essentially of from 15.5% to 20% chromium, from 11% to 14% manganese, from 1.1% to 2.5% nickel, from 0.06% to 0.12% carbon, from 0.20% to 0.38% nitrogen, up to 0.06% phosphorus, up to 0.04% sulfur, up to 1% silicon, and balance iron except for incidental impurities, all percentages being by weight.

8. The article claimed in claim 7, containing from about 17.0% to about 19.0% chromium, from about 11.5% to about 13.5% manganese, from about 1.1% to about 2.0% nickel, from about 0.08% to about 0.12% carbon, from about 0.27% to about 0.35% nitrogen, up to about 0.04% phosphorus, up to about 0.03% sulfur, from about 0.2% to about 0.7% silicon, and remainder substantially iron except for incidental impurities.

* * * * *

UNITED STATES PATENT OFFICE

CERTIFICATE OF CORRECTION

Patent No. 3,989,474 Dated November 2, 1976

Inventor(s) George N. Goller and Ronald H. Espy

It is certified that error appears in the above-identified patent and that said Letters Patent are hereby corrected as shown below:

Title Page, Left Column, "Ronald E. Espy"

should read --Ronald H. Espy--.

Column 1, line 67, "15% to 16% carbon"

should read --15% to 16% chromium, from 16% to 17.5% manganese, less than 1% nickel, 0.10% carbon--.

Column 2, lines 33-34, "conductive"

should read --conducive--.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*